United States Patent [19]

Smith

[11] Patent Number: 4,841,674

[45] Date of Patent: Jun. 27, 1989

[54] ATHLETIC NUMERICAL INDICATOR DISPLAY

[75] Inventor: Robert L. Smith, Kansas City, Mo.

[73] Assignee: Pro Down, Inc., Kansas City, Mo.

[21] Appl. No.: 126,862

[22] Filed: Nov. 30, 1987

[51] Int. Cl.[4] ..... G09F 11/00

[52] U.S. Cl. ..... 40/491; 40/488; 40/476; 40/598

[58] Field of Search ..... 40/299, 491, 476, 490, 40/442, 597, 598

[56] References Cited

U.S. PATENT DOCUMENTS

| | | | |
|---|---|---|---|
| 563,772 | 7/1896 | Jackson | 40/491 |
| 2,141,398 | 12/1938 | Lowenstein | 40/491 |
| 2,208,009 | 7/1940 | Rosenboom | 40/491 |
| 2,401,478 | 6/1946 | Grossman | 40/491 |
| 3,421,240 | 1/1969 | Bardi | 40/491 |
| 3,799,109 | 3/1974 | Vargo | 40/598 |

*Primary Examiner*—Gene Mancene

*Assistant Examiner*—Wenceslao J. Contreras

*Attorney, Agent, or Firm*—Hovey, Williams, Timmons & Collins

[57] ABSTRACT

A portable impact-resistant athletic numerical indicator display produces highly visible numerals for observation by athletic participants and spectators. The display is provided with a series of shiftable component numeral panels which are connected to a selector lever by a coupling device including a stationary, slotted bar and yoke. The desired numeral to be displayed is presented behind a transparent face in the body by shifting the corresponding selector lever from a first position to a second position to compose the numeral to be displayed from the component panels. The display is conventionally used in contact sports such as football and is constructed to withstand impact with a player or the ground. The display is preferably mounted on a pole and is provided with a layer of padding to protect the players from injury.

12 Claims, 4 Drawing Sheets

ATHLETIC NUMERICAL INDICATOR DISPLAY

BACKGROUND OF THE INVENTION

1. Field of the Invention

This invention relates to an athletic numerical indicator display which has numerous advantages, including easy portability, high visibility, increased safety and a high degree of impact resistance. More particularly, it is concerned with an athletic numerical indicator display, in the nature of a fottbll down marker, which has a series of shiftable numeral panels which, when a corresponding shift lever is engaged, selectively move into position behind the transparent face of the body of the display. The sequentially shifted panels move so as to overlie the previously displayed numeral panel to thereby present the desired numeral in position behind the transparent face.

2. Description of the Prior Art

A variety of athletic events commonly require officials, scorers or the like to display numerals to indicate the appropriate period, score, or number of fouls involved in the athletic event. For example, in football games, it is commonly the practice to indicate the down currently in play by a set of ring mounted panels carried by a pole which also indicates the location of the line of scrimmage. In track and field competition, it is often desirable to digitally display the height of the last jump or vault, or the distance travelled by a throwing implement such as a discus or javelin. In basketball, when an individual commits a personal foul, it is commonly the practice to display to the contestants, coaches and spectators the number of fouls that contestant has committed.

In all of the foregoing events, various devices for displaying the appropriate numeral have been used in the past. For example, the conventional football down marker has a series of numerals displayed on panels which are "flipped over" to display the down in play. In basketball, lighted towers or hand-held paddles are used to display the number of fouls. In track and field events, a book with a group of ring mounted flip-over cards bearing the correct numeral are used by the scorers to display the height or distance for that competitor.

More recently, a numerical display has been developed in France which uses selector levers to provide a digital display for athletic events. This display has provided a compact and self-contained means of displaying desired numerals, with the added advantage that it can be operated with one hand. It conventionally employs a series of numeral panels within a body which panels are moved into position by a selector lever. While this display has been generally acceptable for light duty use, it is difficult and time consuming to construct because of the number of separate parts which require hand assembly. Because of the number of parts and the limited reinforcing and panel guiding structure in this known display, it has been particularly susceptible to damage arising from impact with a player or from being dropped on a hard surface. Finally, the digital display device previously in use has lacked sufficient structure to ensure that each of the numeral panels remains in proper alignment during use.

SUMMARY OF THE INVENTION

The problems outlined above are in large measure solved by the present athletic numerical indicator display since it is a compact, self-contained, impact resistant display specially designed to withstand the rigors of outdoor athletic use.

The present display broadly includes a body having at least one and preferably two transparent faces, a series of numerals made up of component panels located interiorly of the body, at least one selector lever extending through said body for shifting said panels, and a coupling device connecting selected numeral panels to the respective selector levers for movement along a stationary, slotted bar by a yoke coupled to the lever. Preferably, the slotted bar is secured to a frame mounted within the body and the coupling device is mounted within the frame.

The display includes one set of numeral panels mounted on the frame with the remaining panels mounted on shiftable guide means. The selector levers may be held in position by a retaining device when moved into a second, shifted position. The panels are mounted on the guide means and frame in staggered and overlapping relationship so that engagement of the selector lever causes desired panels to move in sequential, superposed relationship into a viewable position behind the transparent face of the body. The body of the display is preferably provided with a layer of padding around its perimeter to prevent injury to a player coming into contact with the display.

DESCRIPTION OF THE PREFERRED EMBODIMENT

Figure 1:
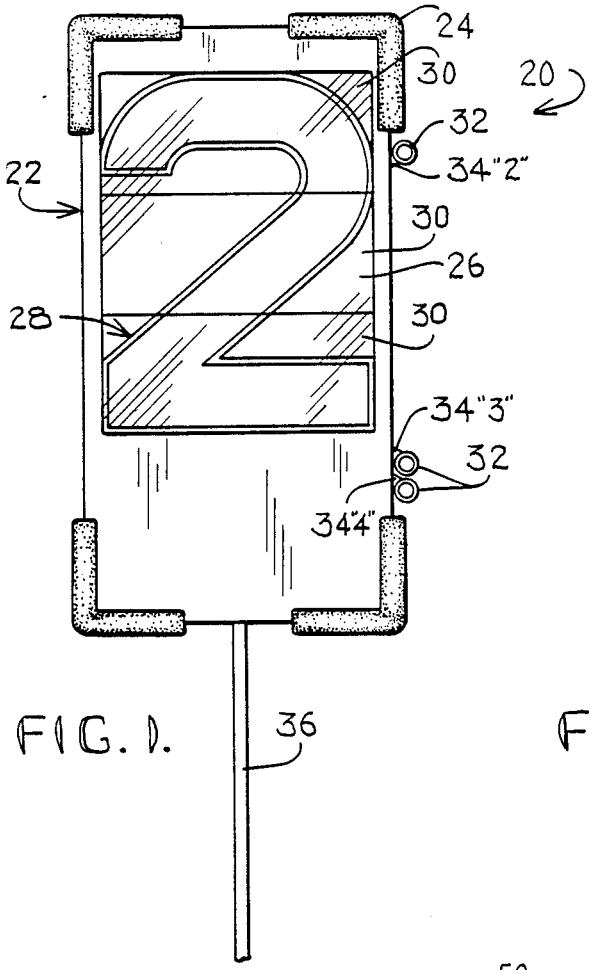
FIG. 1 is an elevational view of the front of the athletic numerical indicator display in accordance with the present invention.

The athletic numerical indicator display 20 is provided with body 22 surrounded at its corners by padding 24. The front of body 22 is shown in FIG. 1, and presents a transparent face 26 with the remaining portions of the front of the body being opaque. Visible through transparent face 26 is a numeral 28 which is composed of component numeral panels 30. Handles 32 are located at the ends of selector levers 34 which extend through a side of body 22. A pole 36 or other support means is provided to carry and support the body 22.

Figure 2:
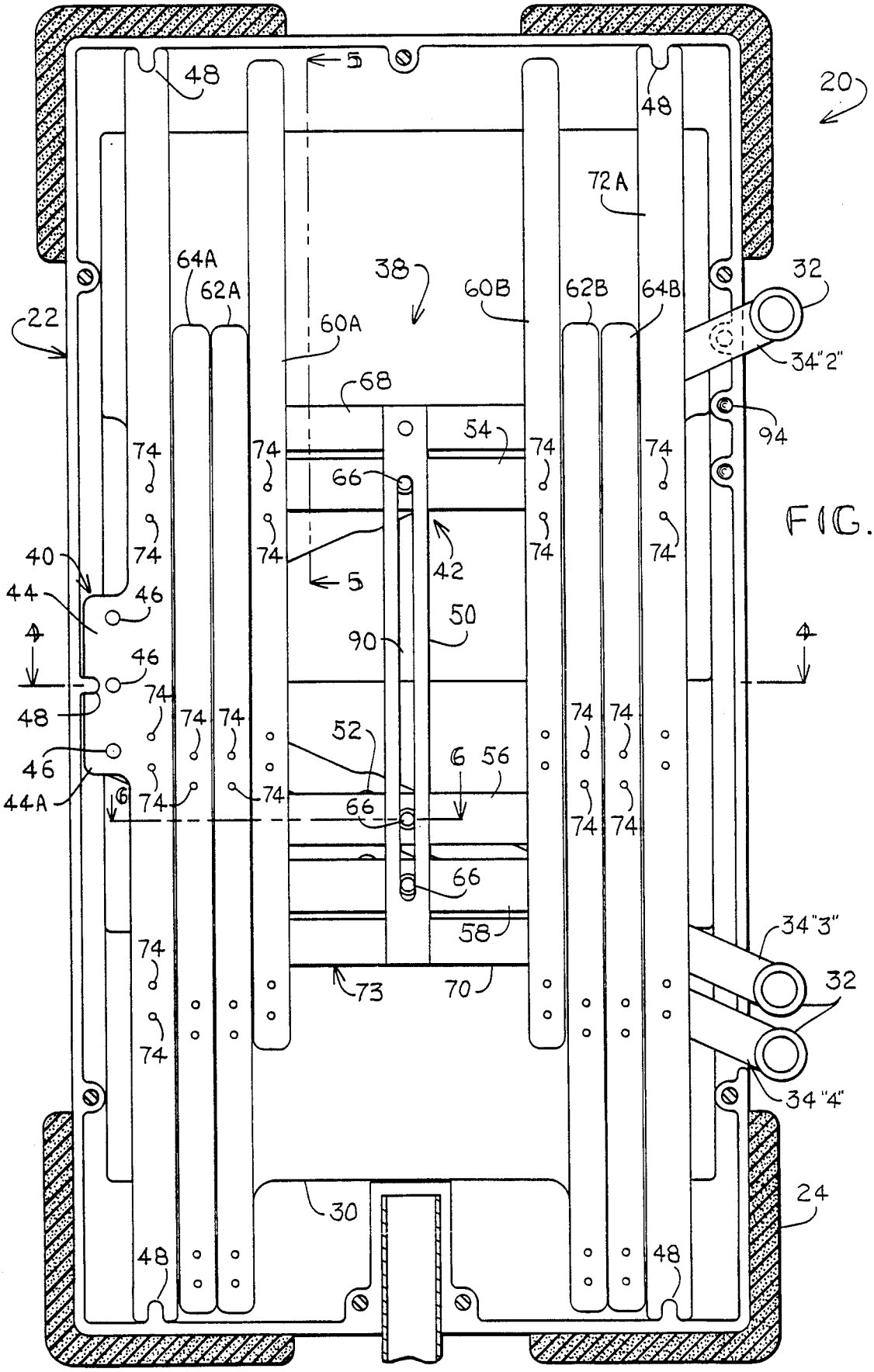
FIG. 2 is a vertical sectional view of the display with the front of the body and the component numeral panels removed.

Referring to FIG. 2, the display 20 is shown with the front cover of the body 22 and the front component numeral panels removed to reveal the selector mechanism 38. Selector mechanism 38 broadly includes elongated selector levers 34, coupling means 40 and connecting means 42.

In more detail, coupling means 40 includes a stretch 44 which carries pivot pins 46. Preferably, stretch 44 is a symmetrical double stretch 44A and 44B located on the front and back sides respectively of lever 34. Thus, pivot pins 46 each extend through the front half 44A of stretch 44, through a corresponding selector lever 34 and into the back half 44B of stretch 44. Each lever 34 is thus free to pivot on its pin 46. Stretch 44 is securely fastened to body 22 at interlocking joints 48 on the interior perimeter of the body 22, which fastening strengthens the entire display.

Figure 3:
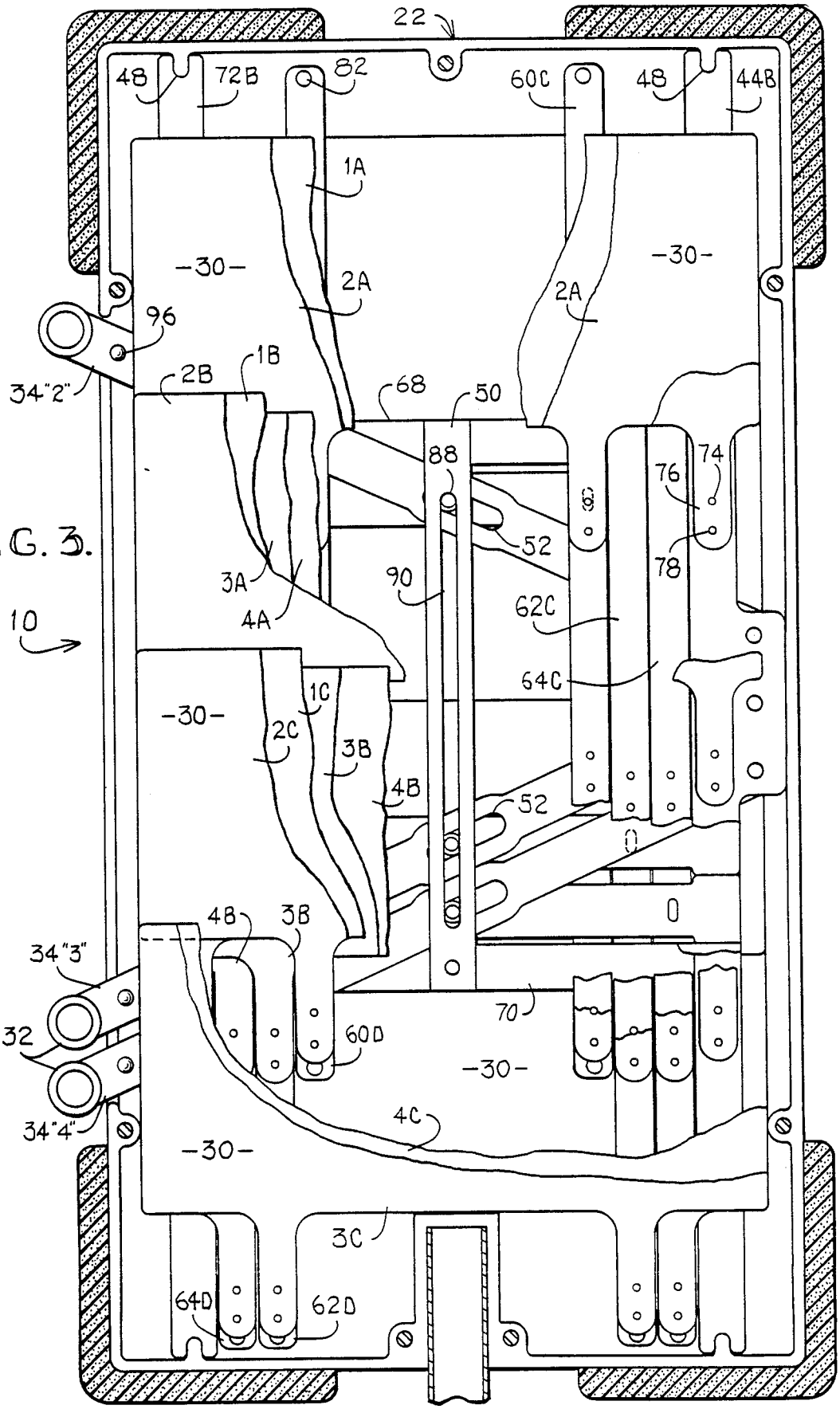
FIG. 3 is a fragmentary vertical sectional view showing the arrangement of the component numeral panels on the selector device portions of the panels being broken away to reveal details of construction.

Connecting means 42 includes a stationary slotted bar 50, a yoke 52 mounted on the selector levers 34, cross bars 54, 56 and 58 respectively connected to vertical arms 60A and 60B, 62A and 62B, and 64A and 64B. The rear of the selector mechanism 38 carries similar arms 60C and 60D, 62C and 62D, and 64C and 64D all as shown in FIG. 3. Cross bars 54, 56, 58 are connected to the yoke 52 and corresponding selector levers 34 by yoke pins 66. Slotted bar 50 is maintained in a stationary position by cross beams 68, 70 secured to stretches 44A and 44B and struts 72A and 72B. Struts 72A and 72B are also fixed to body 22 by interlocking joints 48 on the body. Strut 72A is located on the front side of the display 20 and strut 72B is located on the rear side of the display 20, both struts being similar and arranged symmetrically. Struts 72A, 72B, stretches 44A, 44B, and cross beams 68, 70 are secured together to form a fixed frame 73 in the interior of body 22. A stationary, slotted bar 50 is fixedly secured within the frame 73. Selector mechanism 38 is positioned interiorly of frame 73.

Pairs of locator pins 74 are located in vertical alignment along each stretch 44A and 44B, struts 72A and 72B and vertical arm 60A, 60B, 60C, 60D; 62A, 62B, 62C, 62D; and 64A, 64B, 64C and 64D all as best shown in FIGS. 2 and 3. The pairs of locator pins 74 on stretch 44A are aligned in both horizontal planes with the locator pins 74 on stretch 44B and horizontally aligned in one plane across the width of display 20 with the pairs of locator pins 74 on struts 72A, 72B. Similarly, the locator pins 74 on each front vertical arm are horizontally aligned with the corresponding rear vertical arm (60A to 60C, 60B to 60D; 62A to 62C, 62B to 62D; and 64A to 64C; 64B to 64D) and horizontally aligned across the width of display 20 with locator pins 74 on the corresponding vertical arms on the other side of slotted bar 50 (60A to 60B, 60C to 60D; 62A to 62B, 62C to 62D; and 64A to 64B, 64C to 64D).

As shown in FIG. 3, each panel 30 is provided with integrally formed positioning tabs 76. Each tab 76 is provided with locator holes 78 enabling the tabs 76 to be fitted on locator pins 74. In the embodiment illustrated in the drawings which is intended for use as a football down marker, four numerals "1", "2", "3" and "4" would be displayed. Three separate panels 30 combine together in vertical alignment to form the numeral displayed. In the drawings, the topmost panel 30 for each numeral is identified by the letter "A", the middle panel 30 by the letter "B" and the bottom panel 30 by the letter "C". Thus, panels "1A", "1B" and "1C" combine to form the numeral "1" appearing behind the transparent face 26 of the body 22.

Figure 5:
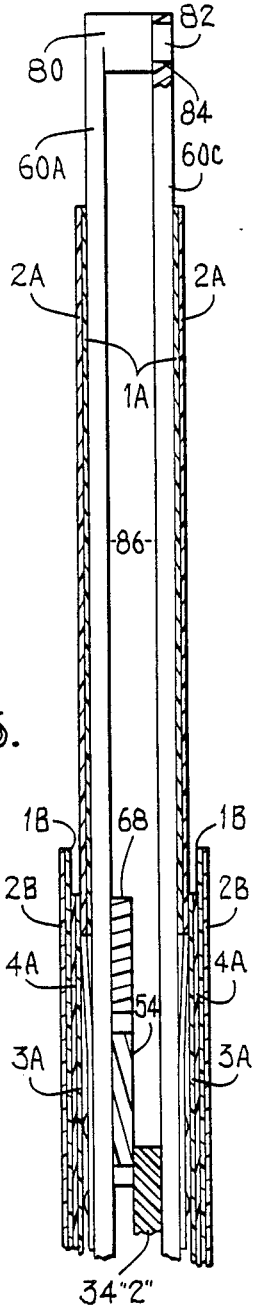
FIG. 5 is a partial vertical sectional view along line 5—5 of FIG. 2 with the body of the display removed to show the vertical alignment of the component numeral panels.

As shown in cutaway in FIGS. 3 and 5, the tabs 76 of each of the panels are attached to stretch 44 and struts 72 and to vertical arms 60, 62 and 64 in staggered and sequential relationship. Referring only to the front side of the display, the panels 30 are thus assembled so that panel "1A" is first secured to the uppermost pair of pins 72 on stretch 44A and strut 72A by gluing, heatsealing or the like, followed sequentially by panels "1B" and "1C" in descending, overlapping arrangement.

Because stretch 44A and strut 72A are fixed and non-shiftable, the numeral "1" will thus appear behind transparent face 26 until panels 30 corresponding to the numerals "2", "3" and "4" are superposed thereover.

Panel "2A" is secured to the uppermost pair of pins 74 on vertical arms 60A and 60B, followed in descending order by panel "2B" and "2C". Panel "3A" is secured to the uppermost pair of pins 74 on vertical arms 62A and 62B, followed by panels "3B" and "3C" in descending order. Finally, panel "4A" is secured to vertical arm 64A and 64B, followed by panels "4B" and "4C". The pairs of pins 74 are located on the respective arms 60, 62 & 64 and the tabs 76 are sized so that panels "C" are located in the opaque portion of body 22 below the transparent face 26 prior to shifting. The panels 30 are sized and arranged so that each successive lower panel "B" and "C" overlaps the next vertically higher panel "A" and "B" respectively so that the top margin of the "B" panel overlaps the "A" panel, and the "C" panel overlaps the "B" panel.

Because each of the numerically superior panels overlaps the next numerically inferior panel, panel "2A" slightly overlaps the bottom of panel "1A", but in turn is obscured by "3A", "4A" and "1B" until shifted into directly overlapping and obscuring relation over "1A". Thus panels 30 are constructed of the same size so that each panel will overlie and obscure its numerical superior of the next higher vertical position among the panels 30 ("1B" obscures "2A", "3A" and "4A"; "1C" obscures "2B", "2C" and "2D") until the next numeral is shifted up into position.

FIG. 5 shows the respective positions of the upper two panels "A" and "B" when the numeral "2" is shifted into view. Panels "2A" and "2B" are in the superposed and therefore viewable positions. Panels "1A" and "1B" along with panel "1C" (not shown) are secured to pairs of pins 74 on the stretches 44 and struts 72 (also not shown). Panels "2A" and "2B" are secured to pins 74 on 60 vertical arms 60A and 60C, and 60B and 60D (not shown). Vertical arm 60A is provided with member 80 extending toward vertical arm 60C and carrying dowel 82 fitting in bore 84. The remaining vertical arms 60B and 60D and vertical arms 62 and 64 are similarly constructed. Member 80 is of sufficient width to allow cross beams 68, 60, selector levers 34, and cross bars 54, 56 and 58 to pass between the vertical arms 60, 62 and 64 in a space 86 created by the member 80.

Panel "3A" slightly overlaps the lower marginof panel "2A" when the numeral "2" is shifted into position, and panel "4A" completely overlaps panel "3A" until panel "3A" is shifted into position. Panels "1B" and "2B" are superposed over panels "3A and "4A" so that no unshifted panel is visible.

Figure 6:
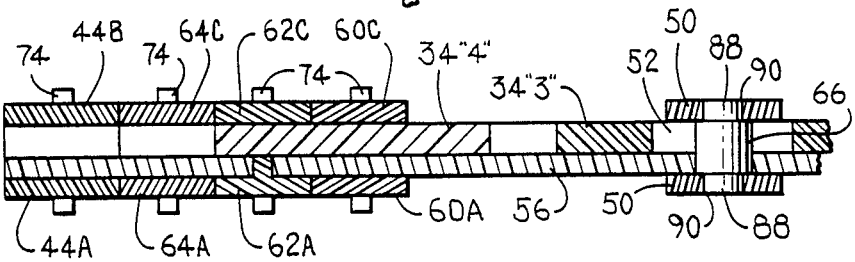
FIG. 6 is a partial sectional view along line 6—6 of FIG. 2 showing the location of the selector lever, yoke, guide bar and guide arms.
Figure 4:
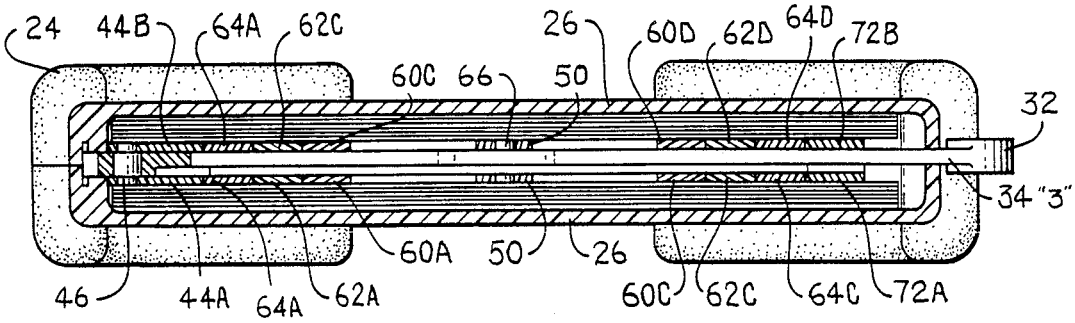
FIG. 4 is a transverse sectional view taken along line 4—4 of FIG. 2 illustrating the positioning of the selector lever within the display.

FIG. 6 shows the structure of the connecting means 42. Yoke pin 66 is fitted between the two slotted bars 50 so that spindle 88 passes into the slot 90. Yoke pin 66 may alternately be integrally formed with cross bars 54, 56 and 58. As shown in FIG. 6, the selector lever 34 "3"

corresponding to the numeral "3" is provided with a yoke 52 through which yoke pin 66 passes. Cross bar 56 is fixed to yoke pin 66 so that cross bar 56 travels up and down slot 90 of slotted bar 50 with yoke pin 66. Yoke 52 on each selector lever 34 is wide enough to permit yoke pin 66 to travel within the yoke 52 during the full range of motion of the selector lever 34 between shifted and unshifted position. Selector lever 34 "3" is shownin FIG. 6, and in the cross section as shown, vertical arms 62, which correspond to the panels 30 for the numeral "3", are secured to connecting arm 56 by boss 92. Panels 30 connected to locator pins 72 are shown in FIG. 3.

Body 22 is provided with detents 94 at the edge opposite stretch 44 and pivot pins 46 as shown in FIG. 2. Corresponding protruberances 96 (shown in FIG. 3) are adapted to fit within detents 94 to provide a means for locking the levers 34 in an upright, shifted position.

Figure 7:
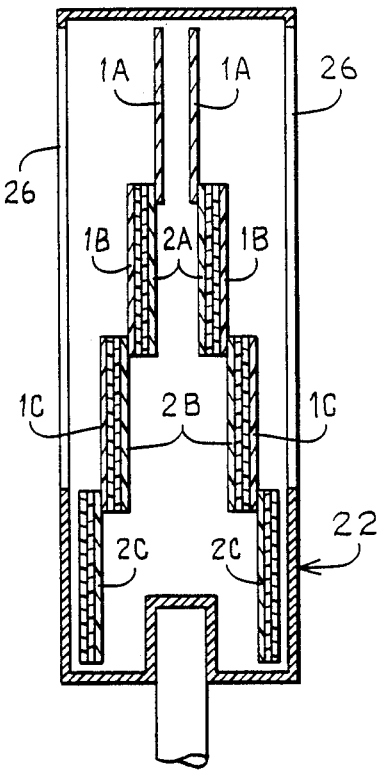
FIGS. 7–10 are schematic sectional views of the athletic indicator display and showing the sequential, superposed relationship of the various component numeral panels as they move into position behind the transparent faces of the body.

In operation, the numeral "1" will appear behind transparent face 26 when no selector levers 34 are shifted up into position. The position of the panels when numeral "1" is indicated is shown schematically in FIG. 7. When the display operator desires to indicate the numeral "2", lever 34 "2" is shifted up relative to the body from a first, unshifted position until protruberance 96 locks in detent 92 to hold the lever 34 "2" in the shifted position.

Figure 8:
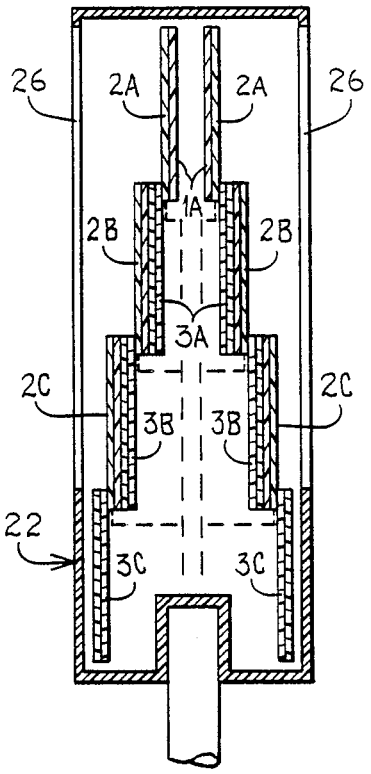

As lever 34 "2" is shifted, yoke pin 66 rides up slot 90 and along yoke 52 carrying cross bar 54. As cross bar 54 ascends up the slot, it carries vertical arms 60A, 60B, 60C and 60D. To each pair of vertical arms 60A and 60B, 60C and 60D are secured three horizontally aligned panels 30, and in the case of the numeral "2" they are "2A", "2B" and "2C" in descending vertical order. The tabs 76 of each panel "2A", "2B" and "2C" being joined to locator pins 74 on the vertical arms 60, the panels "2A", "2B" and "2C" move up with vertical arms 60. The panels "2A", "2B" and "2C" move vertically into position behind transparent face 26 without binding because the top marginal edge of each panel slightly overlaps the lower marginal edge of each corresponding panel "1A", "1B and "1C". In fully shifted position, the panels "2A", "2B" and "2C" combine to present a composite numeral "2", as shown schematically in FIG. 8. The panels 30 corresponding to numerals "3" and "4" remain obscured behind the opaque portion of the body and panels "2B" and "2C".

Figure 9:
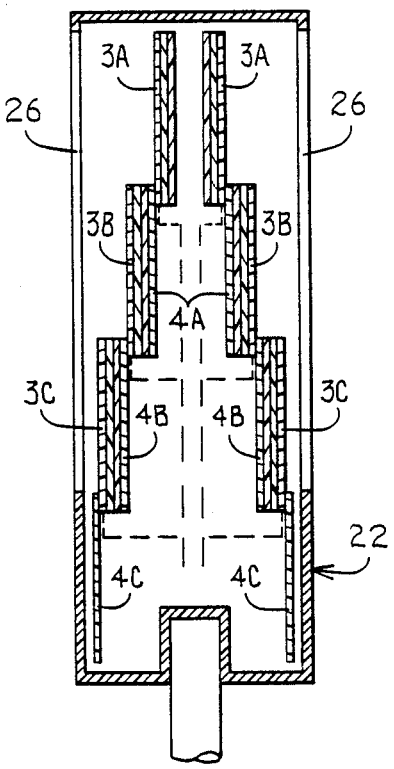
Figure 10:
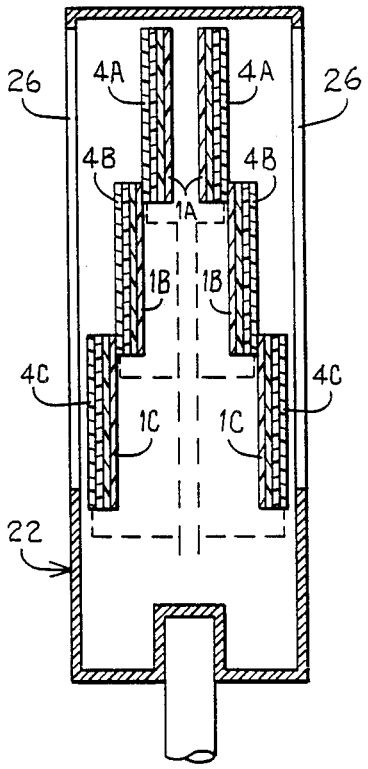

The operation of the selector mechanism 38 is substantially the same in operation to display the numerals "3" and "4". Each overlying and superposed panel is shown schematically shifted into position for the numerals "3" and "4" in FIGS. 9 and 10, respectively. As may be appreciated, the lowermost "C" panels, prior to shifting, remain hidden by the opaque portion of the body 22.

I claim:

1. An athletic numerical indicator display comprising:

a body having at least one transparent face;

a plurality of component numeral panels within said body;

an elongated lever for selecting a numeral to be displayed;

means coupling the lever to said body for shiftable movement between a first and second position;

means for connecting selected component numeral panels to said selector lever, a stationary slotted bar fixed relative to and within said body; and yoke means on said lever and in operable association with said connecting means for displaying a numeral composed of said panels behind said transparent face when said lever is shifted.

2. An athletic numeral indicator display as set forth in claim 1 wherein said body has two transparent faces on opposite sides of said body, and including mated pairs of said component numeral panels whereby engagement of said selector lever causes panels collectively displaying the same numeral to be visible behind each transparent face.

3. An athletic numeral indicator display as set forth in claim 1 including a frame mounted within said body to which said slotted bar is fixedly secured.

4. An athletic numeral indicator display as set forth in claim 3 wherein said selecting means are mounted interior to said frame.

5. An athletic numeral indicator display as set forth in claim 3 wherein the panels composing at least one of said numerals are fixedly mounted to said frame.

6. An athletic numeral indicator display as set forth in claim 1 wherein said coupling means include shiftable guide means operably coupled to said yoke and slotted bar.

7. An athletic numeral indicator display as set forth in claim 6 wherein said guide means comprise a crossbar mounted to vertical arms, said arms shiftably carrying said component numeral panels.

8. An athletic numeral indicator display as set forth in claim 1 including retaining means for detachably securing said lever in a second, shifted position.

9. An athletic numeral indicator display as set forth in claim 1 wherein positioning tabs are integrally formed with said panels.

10. An athletic numeral indicator display as set forth in claim 1 wherein said panels are arrayed in staggered and overlapping relationship for movement into a viewable position behind said transparent face.

11. An athletic numeral indicator display as set forth in claim 1 including support means for said body and extending interiorly thereof.

12. An athletic numeral indicator display as set forth in claim 1 wherein the body is provided with protective padding.

* * * * *